United States Patent [19]

Rösgen et al.

[11] Patent Number: 4,787,356

[45] Date of Patent: Nov. 29, 1988

[54] CARBURETOR ARRANGEMENT FOR CHANGING THE RATIO OF THE AIR/FUEL MIXTURE IN HANDHELD MOTOR-DRIVEN APPARATUS

[75] Inventors: Stephan Rösgen, Cologne; Michael Langer, Fellbach, both of Fed. Rep. of Germany

[73] Assignee: Andreas Stihl, Waiblingen, Fed. Rep. of Germany

[21] Appl. No.: 67,591

[22] Filed: Jun. 26, 1987

[30] Foreign Application Priority Data

Jun. 27, 1986 [DE] Fed. Rep. of Germany ..... 3621497

[51] Int. Cl.[4] ..... F02M 7/12

[52] U.S. Cl. ..... 123/438; 261/69.2; 261/DIG. 68

[58] Field of Search ..... 123/438, 437, 441; 261/35, 69.1, 69.2, DIG. 68

[56] References Cited

U.S. PATENT DOCUMENTS 2,774,582 12/1956 Bracke ..... 261/DIG. 68 X
3,174,730 3/1965 Barr ..... 261/DIG. 68 X
3,960,126 6/1976 Shinoda ..... 261/DIG. 68 X
4,092,380 5/1978 Pierlot et al. ..... 261/69.1
4,314,535 2/1982 Takeuchi et al. ..... 123/438 X
4,579,097 4/1986 Yamamoto et al. ..... 123/438

*Primary Examiner*—Willis R. Wolfe
*Attorney, Agent, or Firm*—Walter Ottesen

[57] ABSTRACT

A carburetor arrangement changes the ratio of air and fuel in the air/fuel mixture for an internal combustion engine of a handheld motor-driven apparatus such as a chain saw, hedge trimmer or the like. The carburetor arrangement includes a membrane carburetor with a regulating membrane by means of which a valve needle is lifted from a valve seat against the force of a spring. The valve needle and valve seat conjointly define a valve for admitting fuel into a chamber of the carburetor. A positioning member is mounted with respect to the regulating membrane and is actuable in dependence upon the rotational speed of the engine. The actuation occurs such that the valve needle is additionally displaced a further incremental amount in response to a predetermined rotational speed of the engine thereby enriching the air/fuel mixture by an additional amount.

6 Claims, 2 Drawing Sheets

CARBURETOR ARRANGEMENT FOR CHANGING THE RATIO OF THE AIR/FUEL MIXTURE IN HANDHELD MOTOR-DRIVEN APPARATUS

FIELD OF THE INVENTION

The invention relates to an arrangement for changing the ratio of the air/fuel mixture for carburetors of internal combustion engines in a handheld motor-driven tool such as a chain saw, hedge trimmer or the like.

BACKGROUND OF THE INVENTION

German published patent application DE-OS 27 27 274 discloses a membrane arrangement with a valve needle which is liftable from a valve seat and which admits incoming air as required in order to achieve a change of the air/fuel ratio for the mixture whereby it is intended to attenuate pulsations in the intake line. For handheld power tools and similar apparatus, a low overall weight is strived for in order to make the apparatus simple and easy to manipulate without exerting too great a manual effort. The object of making the chain saw as light as possible can affect the stability of the drive at increasingly higher rotational speeds.

SUMMARY OF THE INVENTION

It is an object of the invention to provide an arrangement for changing the air/fuel ratio of the fuel mixture for an internal combustion engine of a handheld apparatus such as a chain saw, hedge trimmer or the like, which provides for an increased enrichment of the air/fuel mixture with fuel when a switching level is reached in the presence of an increasing rotational speed.

The carburetor arrangement of the invention is for an internal combustion engine of a handheld portable tool such as a chain saw, hedge trimmer o the like. The carburetor arrangement includes: a carburetor housing having an interior space; a movable regulating membrane mounted in the space so as to partition the same into a first chamber on one side of the membrane and into a second chamber on the other side of the membrane; a fuel channel communicating with the first chamber and defining a valve seat; a valve needle mounted in the first chamber to define a valve with the valve seat; resilient means for resiliently biasing the valve needle into engagement with the valve seat; the valve needle being operatively connected to the regulating membrane so as to be displaceable against the force of the resilient means and away from the valve seat in response to a movement of the membrane thereby admitting fuel into the first chamber; and, actuating means operatively connected to the valve needle for additionally displacing the latter in the opening direction to open the valve a further incremental amount in response to a predetermined rotational speed of the engine thereby enriching the air/fuel mixture by an additional amount.

BRIEF DESCRIPTION OF THE DRAWING

The invention will now be described with reference to the drawing wherein.

DESCRIPTION OF THE PREFERRED EMBODIMENTS OF THE INVENTION

Figure 1:
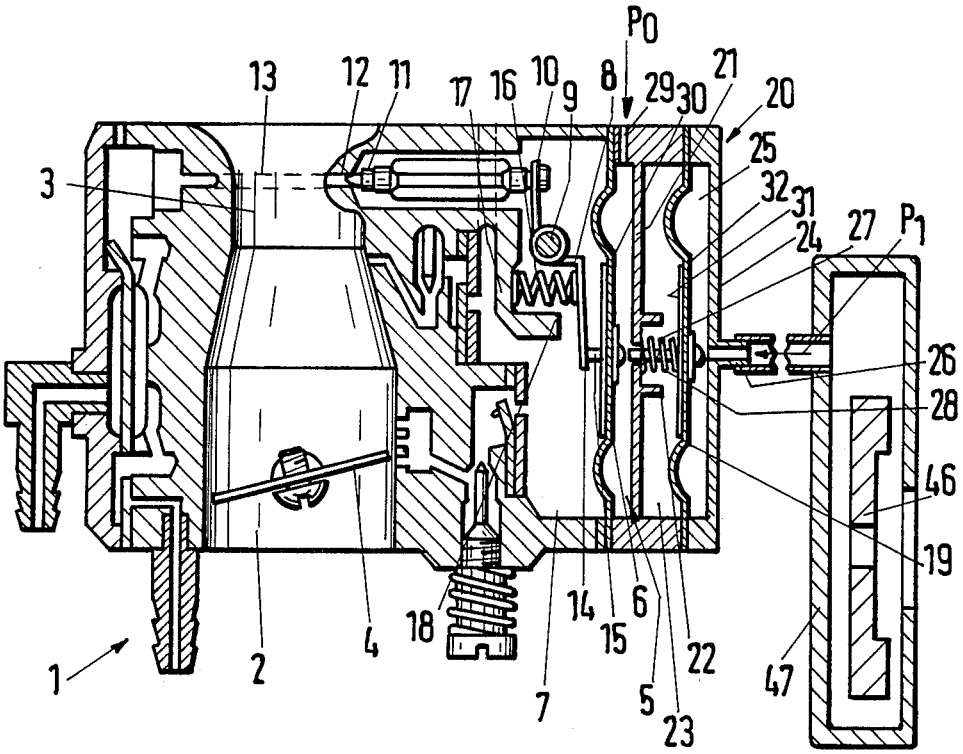
FIG. 1 is an elevation view, in section, of a membrane carburetor arrangement according to the invention equipped with an actuating member associated with the regulating membrane of the carburetor, the actuating member being configured as an overpressure-dependent control membrane.

The carburetor arrangement according to the invention shown in the drawing is for a high-speed internal combustion engine of a handheld tool such as a chain saw. The arrangement includes a membrane carburetor 1 having an intake line 2, a venturi channel 3 and a throttle flap 4.

A regulating membrane 6 is disposed in an interior space 5 of the membrane carburetor 1. The regulating membrane also bounds a pressure chamber 7. An approximately Z-shaped transmitting member 8 is pivotally mounted on a pivot 9 in the pressure chamber 7. The one leg 10 of the transmitting member 8 is mounted on a valve needle 11 which corresponds to and coacts with a valve seat 12 of a fuel channel 13. The other leg 14 of the transmitting member 8 is journalled on a pin 15 which is mounted at the center of the regulating membrane 6. A coil spring 16 presses against the leg 14 and therefore against the regulating membrane 6. The coil spring 16 is braced against a wall portion 17. The valve needle 11 extends parallel to the axis of the pin 15 located in the center of the regulating membrane 6. The valve needle 11 is mounted so as to be radially spaced from the center of the regulating membrane 6 in such a manner that it is located in the vicinity of the outer region thereof. The pivot 9 is located approximately in the center of the transmitting member 8 between the valve needle 11 and the pin 15. The valve needle 11 is loaded by the coil spring 16 in the direction toward valve seat 12 via the transmitting member 8.

The pivot excursion of the leg 14 is limited in the direction against the force of the coil spring 16 by means of an abutment 18. In this way, the opening path of the valve needle 11 is at the same time limited thereby.

An additional control membrane 19 is provided in parallel to the regulating membrane 6. The control membrane 19 is preferably configured so as to be just as large as the regulating membrane 6. This control membrane 19 is disposed in a separate chamber 20 which is bounded by a wall 21. The wall 21 is a partition wall and lies between the regulating membrane 6 and the control membrane 19. A stub-like abutment 22 is formed on the wall 21 and extends into the chamber portion 23 in a direction toward the control membrane 19 so that the path of membrane 19 and therefore the opening excursion of the valve needle 11 is limited.

The other part 25 of chamber 20 lies opposite to the chamber portion 23. A connecting part 26 is located on the wall 24 of part 25 through which the overpressure $P_1$ can be brought into the chamber portion 25. The overpressure $P_1$ is preferably proportional to rotational speed and is established by a motor air fan 46 having a housing 47. Alternatively, an engine muffler can be utilized to provide the overpressure $P_1$.

A pin 27 is mounted on the control membrane 19 so as to be coaxial with pin 15. The pin 27 extends through the wall 21 and is directed against the head portion of pin 15. A compression spring 28 is provided in the chamber part 23 in the region of the abutment 22. The compression spring 28 lies against the wall 21 and acts against the control membrane 19. The chamber 5 and the chamber portion 23 communicate with the ambient air through an opening 29 so that the ambient pressure $P_0$ is applied on the surface 30 of regulating membrane 6 facing toward the control membrane 19 and against the side 31 of the control membrane 19 facing toward the regulating membrane 6; whereas, the opposite lying outer side 32 of the control membrane 19 is charged with the overpressure $P_l$ proportional to rotational speed.

The control membrane 19 is moved against the force of the compression spring 28 by means of the speed-proportional overpressure $P_1$ after a predetermined rotational speed of the motor is exceeded. This causes the pin 27 to be pressed against the pin 15. In this way, the regulating membrane 6 is moved so far toward the left that the Z-shaped transmitting member 8 is pivoted against the force of the coil spring 16 and the valve needle 11 is lifted by an additional amount away from the valve seat 12 thereby further opening the fuel channel 13 so that there occurs an above-average enrichment of the air/fuel mixture with fuel thereby causing a drop in the power of the engine. In this way, the highest rotational speed of the engine, which is proportional to maximum output, is limited in a simple manner. The drop in rotational speed can be adjusted via the pretensioning force of the pressure spring 28.

Figure 2:
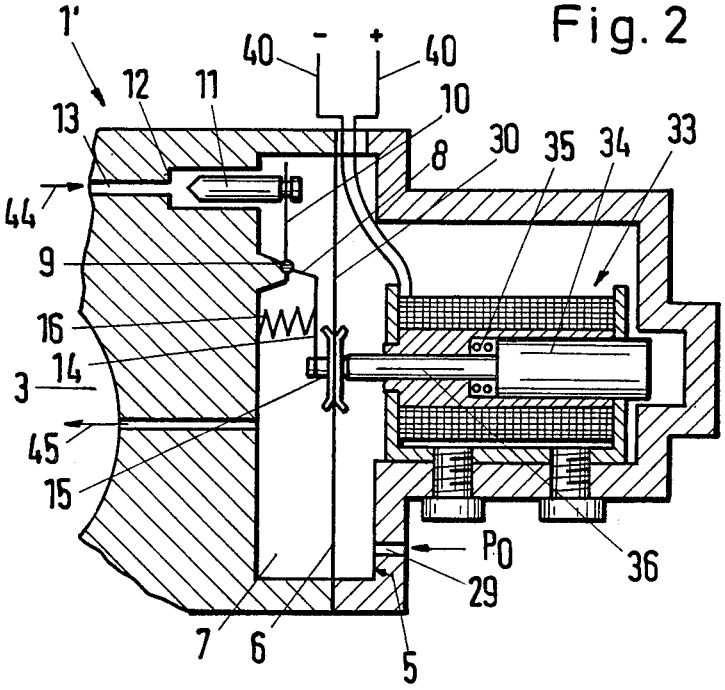
FIG. 2 is another embodiment of the membrane carburetor arrangement according to the invention equipped with a solenoid magnet associated with the carburetor regulating membrane; and, FIG. 3 is a circuit diagram of the voltage supply circuit of the solenoid magnet of FIG. 2 including an ignition module, a rectifier and a trim potentiometer.
Figure 3:
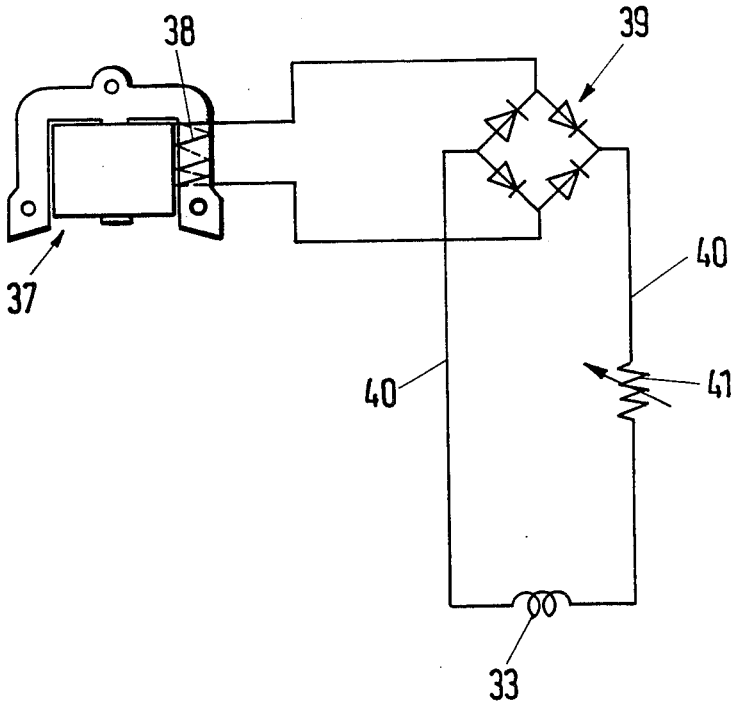

The membrane carburetor 1' according to the embodiment of FIG. 2 is configured substantially in the same manner as that shown in FIG. 1. However, a solenoid 33 is provided as the actuating member instead of the control membrane 19 charged with the overpressure proportional to rotational speed. The armature 34 of the solenoid 33 is directed against the force of a spring 35 with the pin 36 against the pin 15 of the control membrane 6. The solenoid 33 can be supplied with an electric voltage proportional to rotational speed as shown in FIG. 3. For this purpose, an additional coil 38 can be provided on the ignition arrangement 37 and preferably has more than 50 turns. It is also possible to provide the additional coil on a separate iron core. The voltage for the solenoid 33 can also be provided by a generator such as a heating generator.

The uneven alternating voltage which is developed can be transformed into a direct voltage via rectifier 39. The voltage on the solenoid 33 is adjustable by means of a potentiometer 41 which is configured as a trim potentiometer. The potentiometer 41 and the solenoid magnet conjointly define a voltage divider. The stroke through which the armature 34 and therewith the pin 36 passes is dependent upon the direct voltage applied to the solenoid 33 and the force of the spring 35 which acts against the outward movement of the pin 36. The control quantity for the quantity of fuel to be metered can be determined by changing the point of switching, that is by selecting the tension of the spring 35 and by adjusting the potentiometer 41.

For operating conditions which do not reach a predetermined rotational speed, the regulating membrane 6 regulates the pressure in the pressure chamber 7 to a level which lies a small amount below atmospheric pressure. When the predetermined rotational limit speed is reached, the solenoid 33 is charged with electrical voltage via contacts "+" and "−". The armature 34 is pulled via the electro-magnetic force against the spring 35 toward the left as viewed in the drawing and presses with its free end against the pin 15 of the regulating membrane 6. With this operation, the valve needle 11 is lifted very far away from the valve seat 12 so that the inflow 44 and likewise the outflow 45 is increased. Since a larger fuel flow (outflow 45) reaches the venturi channel 3, the fuel/air mixture is enriched with fuel. This causes the power of the engine to drop whereby the highest rotational speed is limited.

In the context of the invention, it can be advantageous to provide a speed-proportional centrifugal force controller which actuates the pin 27 via a linkage mechanism for enriching the air/fuel mixture.

It is understood that the foregoing description is that of the preferred embodiments of the invention and that various changes and modifications may be made thereto without departing from the spirit and scope of the invention as defined in the appended claims.

What is claimed is:

1. A carburetor arrangement for an internal combustion engine of a handheld portable tool such as a chain saw, hedge trimmer and the like, the carburetor arrangement comprising:

a carburetor housing having an interior space;

a movable regulating membrane mounted in said space so as to partition the same into a first chamber on one side of said membrane and into a second chamber on the other side of said membrane;

a fuel channel communicating with said first chamber and defining a valve seat;

a valve needle mounted in said first chamber to define a valve with said valve seat;

resilient means for resiliently biasing said valve needle into engagement with said valve seat;

said valve needle being operatively connected to said regulating membrane so as to be displaceable against the force of said resilient means and away from said valve seat in response to a movement of said membrane thereby admitting fuel into said first chamber;

actuating means operatively connected to said valve needle for additionally displacing the latter in the opening direction to open the valve a further incremental amount in response to a predetermined rotational speed of the engine thereby enriching the air/fuel mixture by an additional amount; and, abutment means for limiting the additional displacement of said valve needle for the enrichment of said air/fuel mixture.

2. A carburetor arrangement for an internal combustion engine of a handheld portable tool such as a chain saw, hedge trimmer and the like, the carburetor arrangement comprising:

a carburetor housing having an interior space;

a movable regulating membrane mounted in said space so as to partition the same into a first chamber on one side of said membrane and into a second chamber on the other side of said membrane;

a fuel channel communicating with said first chamber and defining a valve seat;

a valve needle mounted in said first chamber to define a valve with said valve seat;

resilient means for resiliently biasing said valve needle into engagement with said valve seat;

said valve needle being operatively connected to said regulating membrane so as to be displaceable against the force of said resilient means and away from said valve seat in response to a movement of said membrane thereby admitting fuel into said first chamber;

actuating means operatively connected to said valve needle for additionally displacing the latter in the opening direction to open the valve a further incremental amount in response to a predetermined rotational speed of the engine thereby enriching the air/fuel mixture by an additional amount;

a control membrane mounted in said interior space so as to be disposed adjacent the other side of said regulating membrane to define a wall of said second chamber and said control membrane having a first side facing said other side of said regulating membrane and a second side facing away from said regulating membrane;

second resilient means for resiliently biasing said control membrane on said first side thereof in a direction away from said regulating membrane;

passage means for conducting ambient air into said second chamber for charging said control membrane on said first side thereof;

a pin mounted on said control membrane so as to be directed toward said regulating membrane; and, overpressure means for applying an overpressure dependent upon said rotational speed to said second side of said control membrane for displacing said control membrane against the force of said second resilient means and said pin toward said regulating membrane which, in turn, is displaced to act upon said valve needle to open said valve said incremental amount.

3. The carburetor arrangement of claim 2, said overpressure means comprising an air fan driven by the engine.

4. The carburetor arrangement of claim 2, said housing having a partition wall for partitioning said second chamber into a first compartment bounded by said regulating membrane and said partition wall and a second compartment bounded by said control membrane and said partition wall; said partition wall having an aperture formed therein and said pin extending through said aperture for acting on said regulating membrane in response to said overpressure; said housing including a further wall conjointly defining a third chamber between said further wall and said control membrane; and, said overpressure means including a connector for conducting said overpressure into said third chamber for acting upon said second side of said control membrane.

5. The carburetor arrangement of claim 4, said valve needle and said pin defining respective longitudinal axes extending transversely to said membranes; said pin being mounted on said control membrane at the center region thereof and said valve needle being mounted in said first chamber so as to cause its longitudinal axis to be radially spaced from the longitudinal axis of said pin; and, a transmitting member disposed between said axes for transmitting the movement of said regulating membrane to said valve needle.

6. The carburetor arrangement of claim 5, said transmitting member having Z-shaped configuration.

* * * * *